US006090305A

United States Patent [19]

Balch et al.

[11] Patent Number: 6,090,305

[45] **Date of Patent: *Jul. 18, 2000**

[54] HEATER FOR USE IN ELECTROPHOTOGRAPHIC IMAGE FIXING DEVICE

[75] Inventors: Stacey Edward Balch, Versailles; Peter Alden Bayerle; Douglas Campbell Hamilton, both of Lexington, all of Ky.

[73] Assignee: Lexmark International, Inc., Lexington, Ky.

[ * ] Notice: This patent issued on a continued prosecution application filed under 37 CFR 1.53(d), and is subject to the twenty year patent term provisions of 35 U.S.C. 154(a)(2).

[21] Appl. No.: 09/270,891

[22] Filed: Mar. 15, 1999

[51] Int. Cl.[7] ..... G03G 15/20

[52] U.S. Cl. ..... 216/216; 399/69; 399/329

[58] Field of Search ..... 219/216, 465, 219/467, 448.11, 448.17, 541, 543, 552, 553; 399/328, 329

[56] References Cited

U.S. PATENT DOCUMENTS

| | | | |
|---|---|---|---|
| 4,505,783 | 3/1985 | Mase et al. | 204/1 T |
| 4,697,165 | 9/1987 | Ishiguro et al. | 338/34 |
| 4,762,982 | 8/1988 | Ohno et al. | 219/508 |
| 4,883,947 | 11/1989 | Murase et al. | 219/553 |
| 5,444,521 | 8/1995 | Tomoyuki et al. | 355/285 |
| 5,493,379 | 2/1996 | Koroda et al. | 355/290 |
| 5,541,719 | 7/1996 | Tamaki | 355/285 |
| 5,592,277 | 1/1997 | Kusaka et al. | 399/328 |
| 5,656,187 | 8/1997 | Miyamoto et al. | 219/216 |
| 5,732,318 | 3/1998 | Natsuhara et al. | 399/329 |
| 5,753,889 | 5/1998 | Kondo et al. | 219/216 |
| 5,828,035 | 10/1998 | Kuroda | 219/216 |
| 5,852,763 | 12/1998 | Okuda et al. | 399/329 |
| 5,860,052 | 1/1999 | Ohtsuka et al. | 399/329 |
| 5,874,710 | 2/1999 | Yoshimoto et al. | 219/216 |
| 5,915,146 | 6/1999 | Kusaka et al. | 219/216 |
| 5,920,757 | 7/1999 | Izawa et al. | 399/329 |

FOREIGN PATENT DOCUMENTS

| | | |
|---|---|---|
| 63-313182 | 12/1988 | Japan . |
| 3144676 | 6/1991 | Japan . |
| 6-202503 | 7/1994 | Japan . |
| 6-202510 | 7/1994 | Japan . |
| 6-202512 | 7/1994 | Japan . |

*Primary Examiner*—Joseph Pelham
*Attorney, Agent, or Firm*—John A. Brady

[57] ABSTRACT

A ceramic heater for use in an electrophotographic printing process, particularly for use with a belt fuser to fix toner images, is disclosed. This heater is preferably made from a ceramic material substrate and contains a heat-generating resistor and electrical connections for said resistor on one face of the substrate and a temperature-detecting element for detecting and controlling the temperature of said heater, together with electrical connections for said detecting element, on the opposing face of the substrate. Belt fusers, which incorporate these heaters, are also disclosed.

18 Claims, 4 Drawing Sheets

HEATER FOR USE IN ELECTROPHOTOGRAPHIC IMAGE FIXING DEVICE

TECHNICAL FIELD

The present invention relates to heaters used in an electrophotographic printing process and particularly to heaters used with a belt fuser to fix toner images on paper.

BACKGROUND OF THE INVENTION

Most of the conventional fixing apparatuses for electrophotographic printing processes are of a heat roller type. The heat roller fixing apparatus includes a heat roller maintained at a predetermined temperature and a pressing roller having an elastic layer which is press-contacted to the heating roller. A transfer material, for example paper, which has an unfixed toner image on it, is passed through the nip between the heat roller and the pressing roller and heated to fix the image. In this type of image fixing apparatus, there frequently is a problem due to the so-called "toner offset phenomenon." That is, toner undesirably transfers from the paper to the heating roller. In order to prevent the toner offset phenomenon, the temperature of the heating roller has to be maintained at an optimum level. This requires a large thermal capacity for the heat roller. The large thermal capacity requires a longer period of time to increase the temperature of the heat roller to the required operating level, thereby necessitating a longer waiting time upon start of the apparatus.

In order to alleviate the above-mentioned problems, the following types of fixing apparatuses have been proposed:

1. a fixing apparatus having an electrically conductive, self-heating (resistance) film as the fixing film (see, for example, Japanese Laid Open Patent Application 3-144676); and
2. a fixing apparatus heating intensively a transfer material through a fixing film (see, for example, Japanese Laid Open Patent Application 63-313182 and U.S. Pat. No. 5,493,379, Kuroda, et.al., issued Feb. 20, 1996). This latter type of device is known as a heated belt fuser.

In a heated belt fuser apparatus, a heater (generally a ceramic heater) is in contact with a belt (made, for example, from a polyimide material) which moves at the same speed as the paper carrying the unfixed toner image. A pressing roller forms a nip with the heated belt through which the paper passes. As the paper passes through the nip, the heated belt fixes the toner image on the paper. Because the heater heats up quickly and also includes a temperature detecting and regulating device, which carefully controls the temperature of the heater/belt within the desired range, the heated fuser belt apparatus overcomes the problems discussed above.

The heater used in a heated belt fuser apparatus typically comprises one or more resistors, typically coupled to an AC current source, to provide the required heat, and a temperature detection and regulation device, such as a thermistor or thermostat, typically connected to a DC current source, to sense and control the overall temperature of the heater and, therefore, of the fuser belt. This temperature control keeps the temperature of the fuser belt within the desired range for fixing the toner, as well as preventing fires and scorching of the paper on which the toner image is printed. The heater is generally made from a flat ceramic material having two faces and two ends. The various components of the heater can be placed on the ceramic substrate in a variety of locations. For example, both the resistor wires and the temperature detection device can be placed on one face of the substrate. Generally, however, one component is placed on each face of the substrate (for example, the resistor wires being placed on the top (front) face, which contacts the fuser belt, and the temperature detection device being placed on the bottom (back) face of the substrate).

The electrical terminals for the resistor wires and the temperature detection device are frequently located on one face of the heater (i.e., both on the top face or both on the bottom face of the substrate). Thus, for example, U.S. Pat. No. 5,493,379, Kuroda et.al., issued Feb. 20, 1996, describes a heater for use with a fuser belt device. In FIG. 3, a heater having the heating resistor on the top face of the substrate and the temperature sensor on the bottom face of the substrate is shown. In this illustrated device, both the AC electrical terminal for the resistor and DC terminal for the temperature sensor are connected on the bottom face of the substrate. This patent teaches that if the AC power to the resistor comes in at one longitudinal end of the substrate and the DC power for the temperature sensor comes in at the opposite longitudinal end, the AC and DC sources are as far from each other as possible and this minimizes electrical noise in the DC line (which can cause erroneous readings in the temperature sensor).

This type of structure results in a number of problems for the ceramic heater. Specifically, it requires that holes be drilled through the ceramic substrate to complete the electrical connection. This weakens the substrate and increases the chance of breakage and waste during the manufacturing process and during use. Further, placement of both connections on the same side of the substrate generally requires a larger substrate, increasing the size and materials costs of the ceramic heater.

It has now been found that if the ceramic heater is formulated such that the resistor wires and the temperature detection device are placed on opposite faces of the substrate and that the electrical connections for each these components is placed on the same face of the substrate as its connected circuit lies, these problems are overcome. Thus, for example, the resistor wires may be placed on the top face of the substrate and the AC connection for the resistors is also made on the top face, while the temperature detection device is placed on the bottom face of the substrate and the DC connection for that device comes into the bottom face. This approach to formulating ceramic heaters for use in a fuser belt device means that the heater substrate can be made smaller, which lowers their cost. In addition, holes through the substrate are eliminated, making the heater easier to manufacture and minimizing substrate breakage during both manufacture and use.

Ceramic heaters are well known in the art for a variety of purposes.

U.S. Pat. No. 4,762,982, Ohno, et.al., issued Aug. 9, 1988, describes glow plugs which incorporate ceramic heaters and are used in diesel engines. The purpose of the invention is to avoid cracks in the ceramic heaters at the high temperatures required in diesel engines (approximately 900–1150° C.). This is accomplished by reversing the direction of current flow in the heater during alternate usages of the heater. Figure 6 of the patent illustrates a heater which includes two DC resistor wires; all electrical terminals for the heater are located on the same side of the ceramic substrate.

U.S. Pat. No. 4,697,165, Ishiguro, et.al., issued Sep. 29, 1987, describes a heater/oxygen sensor device that is used for monitoring automobile exhaust gases. Figures 1 and 5 of the patent illustrate a device having an oxygen sensor on the top surface (with no power leads) and a ceramic heater with its power leads on the bottom surface.

U.S. Pat. No. 4,505,783, Mace, et.al., issued Mar. 19, 1985, describes an oxygen sensor device for use in an automobile which includes both temperature sensing and heating components. These components are not placed on opposite faces of the device and the power leads all come in on the same surface of the device (see Figures 1 and 2).

U.S. Pat. No. 4,883,947, Murase, et.al., issued Nov. 28, 1989, describes a ceramic heater for use in an oxygen sensing device. Figure 5 of the patent illustrates a device having an oxygen-sensing component on its top surface and ceramic heater and its connectors to a power source located on the bottom surface of the device.

U.S. Pat. No. 5,541,719, Tamaki, issued Jul. 30, 1996, describes a heated fuser belt device. The patent describes the heater used in this device in very general terms and does not speak to the placement of power connections on the device (see Figure 2 and Column 4, lines 55 et.seq.).

U.S. Pat. No. 5,444,521, Tomayuki, et.al., issued Aug. 22, 1995, describes a heated fuser belt device. The heater used in this device is described in general terms and the patent does not speak to the placement of electrical connections on the heater (see, for example, the top of column 5).

SUMMARY OF THE INVENTION

The present invention relates to a heater, preferably a ceramic heater, for use in an electrophotographic printer process, comprising:

- a base member having two faces and two longitudinal ends;
- one or more resistors extending along the length of the first face of said base member, said one or more resistors capable of generating heat upon supply of electric power thereto;
- first electric power supply contact for supplying electric power to said one or more resistors, said first contact located on the first face of said base member;
- a temperature detecting element for detecting the temperature of said base member, located on the second face of said base member; and
- second electric power supply contact for supplying electric power to said temperature detecting element; said second contact located on the second face of said base member.

In preferred embodiments, the base member is flat and is made from a ceramic material; additionally, the power to the resistors is preferably provided by alternating current (AC) and the power to the temperature detecting element is preferably provided by direct current (DC). In a further preferred embodiment, both the first power supply contact and the second power supply contact are located proximate to the same longitudinal end of the base member.

The present invention also encompasses an image fixing apparatus comprising:

- a heater, as described above;
- a film in slidable contact with said heater; and
- a back-up member cooperative with said heater to form a nip with said heater with said film therebetween; wherein a recording material (e.g., paper) carrying an unfixed toner image is nipped and moved through said nip so that the image is fixed on the recording material.

DETAILED DESCRIPTION OF THE INVENTION

The present invention relates to a unique design for a heater used in an electrophotographic process image-fixing fuser belt device.

Figure 1:
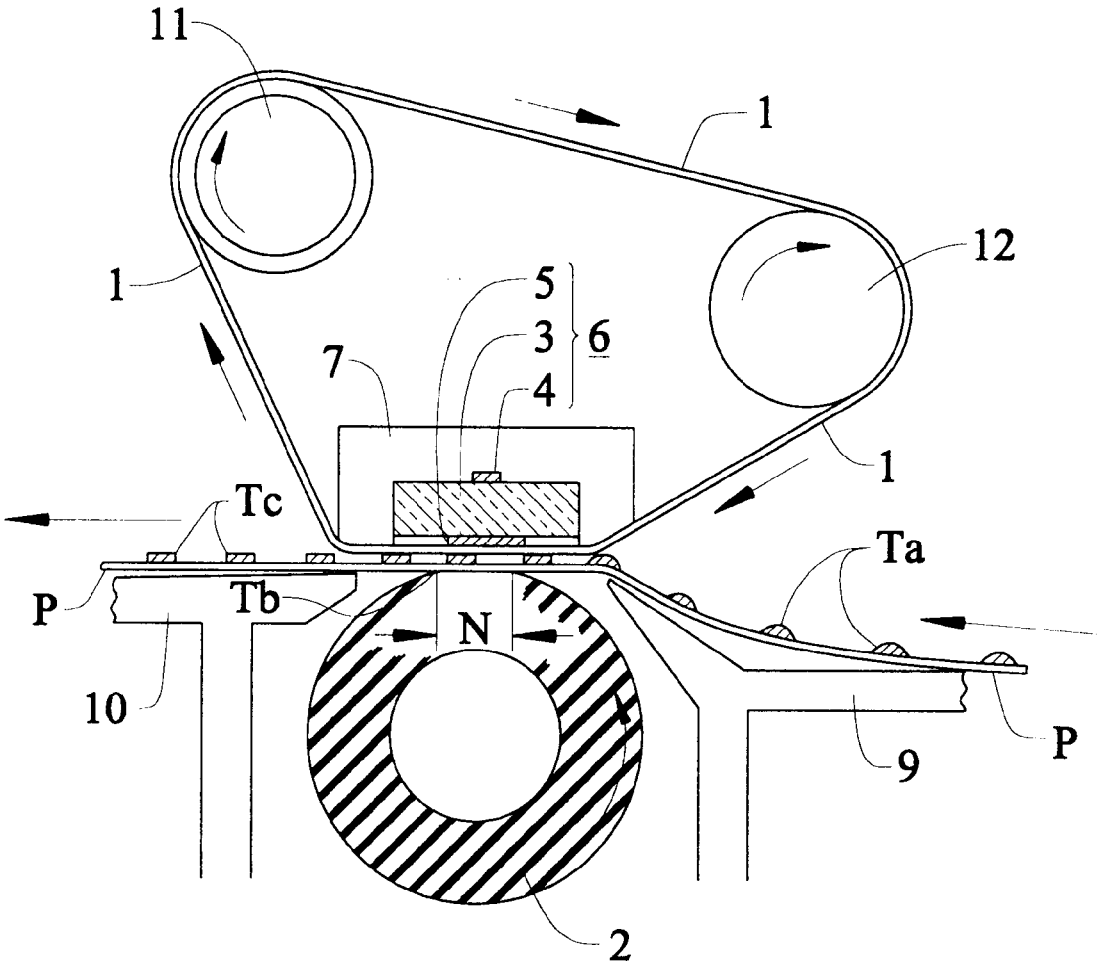
FIG. 1 is a cross-sectional view of a thin film image heating/fusing apparatus.

Referring to FIG. 1, there is shown an image heating/fixing apparatus using a film and a ceramic heater according to an embodiment of the present invention. Designated by reference number 1 is a fixing film in the form of an endless belt. It is extended and stretched around three parallel members 11, 12 and 6, more particularly, a left driving roller 11, a right following roller 12, and a low thermal capacity linear heater 6 (which will be referred to herein as "heater"), fixed at a position below and between the rollers 11 and 12.

The follower roller 12 functions also as a tension roller of the endless fixing film 1. The fixing film 1 is driven by the clockwise rotation of the driving roller 11 at a predetermined peripheral speed (which is the same peripheral speed as that of the recording material P having on its surface an unfixed toner image Ta from an unshown image forming station) without crease, snaking motion or delay.

A pressing roller 2 has a rubber elastic layer made of silicon rubber or the like exhibiting a high parting property. It is urged to the bottom surface of the heater 6 by an urging means with a total force of about 4–7 kilograms with a bottom travel portion of the fixing film 1 interposed between the heater 6 and the pressing roller 2. It is rotated in the counter-clockwise direction.

The fixing film 1 in the form of an endless belt which is rotated, is repeatedly used for fixing the toner image and, therefore, is made of a highly heat resistive and durable material having good parting properties and a total thickness of not more than about 100 microns, preferably less than about 40 microns, more particularly it is a single layer or multi-layer polyimide film or the like.

The heater 6 comprises, as major components, a heater substrate (base member) 3 extending in a direction substantially perpendicular to the film 1 moving direction (sheet feeding direction), which is electrically insulative, has high thermal conductivity, and has high heat resistance, as well as a low thermal capacity, one or more heat-generating resistors 5 in the form of a line or stripe, extending along the length of the substrate on a (front) face of the heater 6 (i.e., the face of the heater which directly contacts the film), and a temperature detecting element 4, for example, a thermistor or thermostat, contacted to a (back) face of the substrate 3 (opposite from the face having the heat-generating resistor 5). The thermal capacity of the heater 6, as a whole, is low. The heater 6 is fixed to a heater holder 7 through thermal insulation with a front face thereof exposed.

Upon generation of an image formation start signal, an image-forming process is carried out in an image-forming station not shown, and a recording material P supplied to the fixing device is guided by an inlet guide 9, and is introduced into a nip N (fixing nip) between the temperature-controlled heater 6 and the pressing roller 2, more particularly, between the fixing film, and the pressing roller 2. The recording material P is passed through the fixing nip N at the same speed as the feeding speed of the recording material P with the surface of the recording material P having the unfixed toner image Ta being contacted to the bottom surface of the film, which is moving in the same direction and at the same speed as the recording material P.

The toner image on the recording material P receives heat from the heater 6 through the film 1 while the toner image-bearing surface of the recording material P is passed through the fixing nip N in pressure contact to the film surface, so that the toner image is fused on the recording material P and becomes a softened and deposited toner image Tb. The recording material P is separated from the film 1 at a point when the recording material P has passed through the fixing nip N.

The recording material P separated from the film 1 is guided by a guide 10 to an unshown pair of discharging rollers. During this operation, the high temperature of the toner Tb (higher than the glass transition point of the toner) is lowered by spontaneous cooling to a level below the glass transition point, so that a solidified toner image Tc is produced. Then, the recording material P, having the image fixed thereon, is discharged.

Figure 2A:
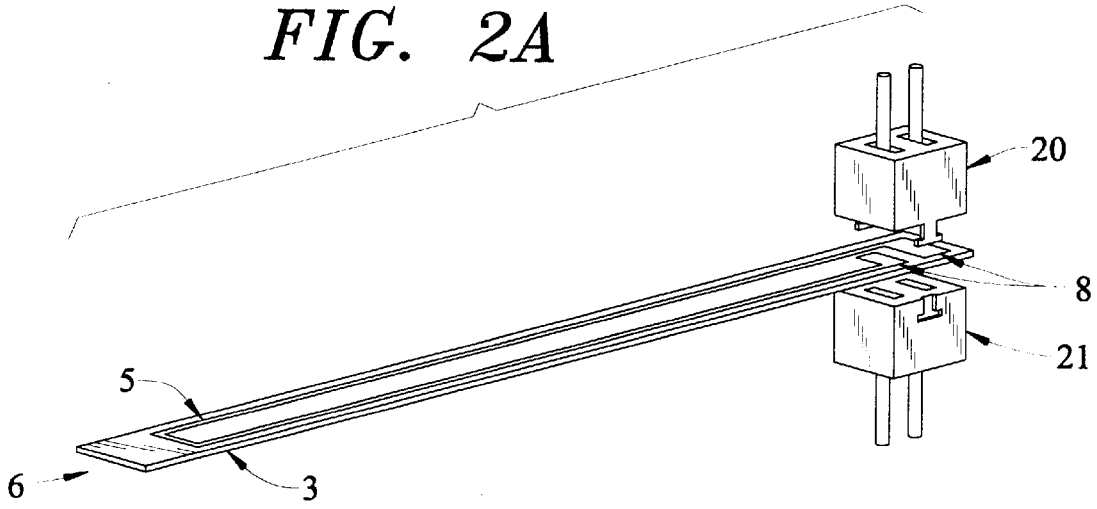
FIG. 2A is a perspective view showing the top face of a first embodiment of the heater of the present invention.
Figure 2B:
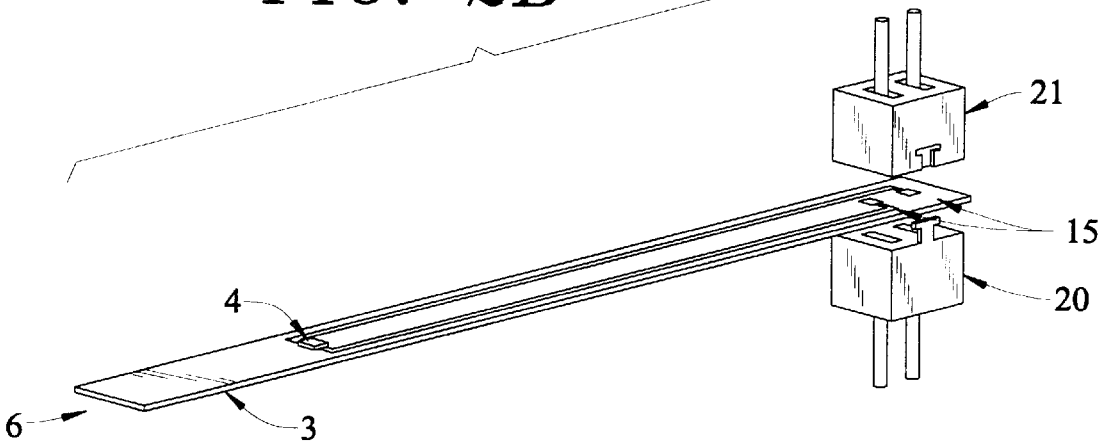
FIG. 2B is a perspective view showing the bottom face of a first embodiment of the heater of the present invention.

To further define the heaters of the present invention, referring to FIGS. 2A and 2B, reference 3 designates a heater substrate, preferably formed from a suitable ceramic material. On one of the opposite major faces of the substrate 3, there is integrally formed a heating element comprised of one or more heat-generating resistors, together with element 5 and two electrical terminals 8 for connecting the heat-generating resistor 5 to an external power source (not shown) for supplying power to the heat-generating resistors 5.

The heat-generating resistors 5 of heater 6 include one or more heat-generating conductors formed in suitable patterns so as to extend in parallel with each other along one of the faces of the heater. These heat-generating conductors are connected in series at their opposite ends to electrical terminals (first power supply contact) 8. The heat-generating conductors are further connected to each other.

To form the heat-generating resistors 5 and the electrical terminals 8 of the heater 6 on a ceramic substrate 3, selected materials are applied to the appropriate face of the ceramic substrate 3, using a suitable known technique such as screen printing, in desired patterns, and the applied materials are fired or baked to form the heater. For improved durability of the heater, the electrical terminals 8, as well as the resistance heat-generating resistors 5, are preferably co-fired with the ceramic substrate 3. In this case, the heat-generating resistors 5 and the electrical terminals 8 are both formed of a cermet or respective cermets, each including a ceramic material and an electrical conductive material. For improved adhesion of the heating resistors 5 to the ceramic substrate 3, the cermet used for the resistors 5 usually includes a ceramic material similar to the material of the ceramic substrate 3. The electrically conductive material is generally selected from the group of noble metals, and preferably from the platinum group, particularly, platinum, rhodium, palladium, osmium and iridium. More preferably, platinum is used as a major component of the electrically conductive material contained in the cermet.

It is noted, however, that the composition for the electrical terminals 8 need not be the same as that for the heat-generating resistors 5, but may include a non-noble or base metal as a major component or may consist of a cermet including a base metal and a ceramic material. For example, the base metal may be selected from niobium, molybdenum, tantalum, tungsten, other metals having a relatively high melting point, aluminum, titanium, chromium, manganese, iron, cobalt, nickel, copper and similar metals, and alloys of the metals described above.

The ceramic substrate 3 carrying the heating resistors 5 intregally formed thereon, is formed of a ceramic material whose major component consists of, for example, zirconia, alumina, mullite, cordierite, fosterite, beryllia or silicon nitride, or a mixture of those materials. Further, the heating resistors 5 may be formed on a ceramic layer, which is formed of the above ceramic materials on a metallic layer or plate. While the ceramic substrate 3 is desirably formed to a flat sheet-like or planar shape, for easy manufacture, the substrate may have other shapes such as a tube or a cylinder.

The heat-generating resistors 5 of the heater 6 formed on a ceramic substrate 3 are generally covered and protected by a protective layer made of alumina or other suitable material, whereby a resistant ceramic heater having a laminar structure is formed. The protective layer may be either a dense gas-tight layer or a porous layer. Where the protective layer is a dense gas-tight layer, it effectively prevents the volatilization of the conductive material of the heat-generating portion at an elevated operating temperature, and protects the heat-generating portion from the surrounding or ambient atmosphere. Where the protective layer is a porous layer, thermal stresses may be effectively absorbed or mitigated by it. In the preferred embodiment wherein the heat-generating resistors are sandwiched between an alumina ceramic substrate and the alumina protective layer, the heat-generating resistors are suitably electrically insulated.

FIGS. 2A and 2B illustrate the essence of the present invention. Specifically, FIG. 2A shows the heater 6 having a ceramic substrate 3 which on one (top) face contains heating resistors 5 and the electrical terminals (first power supply contact) 8 for said heating resistors on that same face. It is the top face of the substrate, which contacts directly the film (belt), in the belt fuser system. Each face of the heater of the present invention may have a single or multiple electrical contact or terminal. As used herein, the terms "contact" and "terminal" are intended to cover both single and multiple contacts. Generally, it is preferred that the current source for heating resistors 5 be from an alternating current (AC) power source. Electrical connector 20 is the mode by which electrical terminals 8 are connected to the power source. Typically, the AC connector 20 will be located toward one longitudinal end of the heater face so that it will not interfere with contact between the heating resistors 5 and the film 1.

FIG. 2B shows the opposite (bottom) face of the heater 6. In this view, the bottom face of the ceramic substrate 3 carries the temperature-detecting device 4. This device measures the temperature of the substrate and regulates it, generally using a power supply control means, to remain within a predetermined range. Examples of such devices include thermistors and thermostats. The electrical terminal second power supply connector 15 for this detection device 4 is carried on the same face of the heater substrate 3 as is the detector device 4 itself. The electric current typically used to power the detecting device is direct current (DC), which is hooked into electrical terminal 15 using electrical connector 21. It is to be noted that in this embodiment, both the AC connector 20 and the DC connector 21 are located at the same longitudinal end of the heater 6, and, in fact, are made so they interlock with each other. The AC and DC terminals may be located at the same longitudinal end of the substrate, at opposite longitudinal ends, or anywhere in-between. When both electrical connectors are located proximate to the same longitudinal end of the heater 6, it is important that all safety requirements, such as the IEC 950 safety requirement of at least 5 mm between AC and DC circuits, be met. Further, when both electrical connectors are located proximate to the same longitudinal end of the heater 6, the configuration tends to be somewhat unstable since only one end of the ceramic heater 6 is physically being supported. This problem can be overcome by providing support at the opposite end of the heater.

Figure 3A:
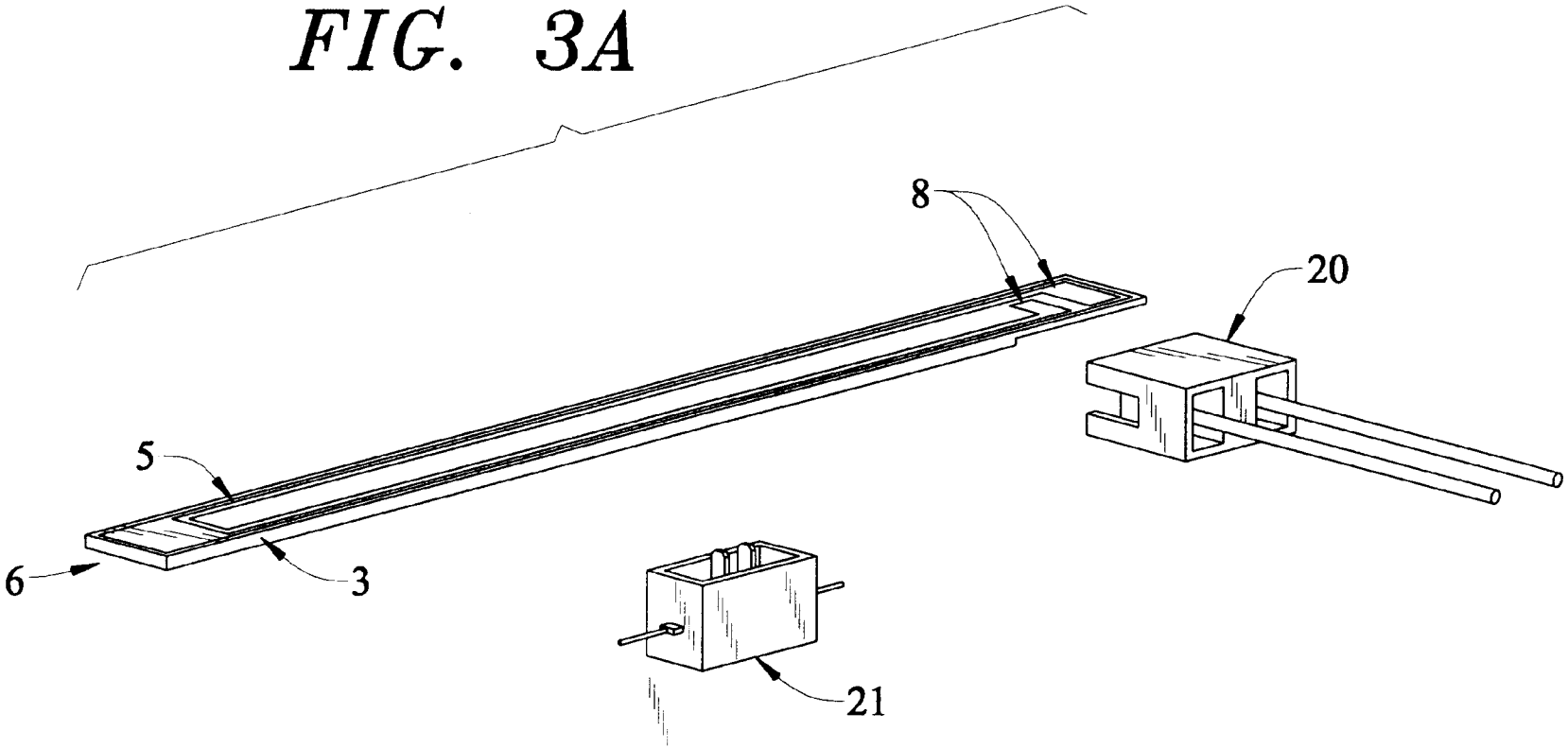
FIG. 3A is a perspective view showing the top face of a second embodiment of the heater of the present invention.
Figure 3B:
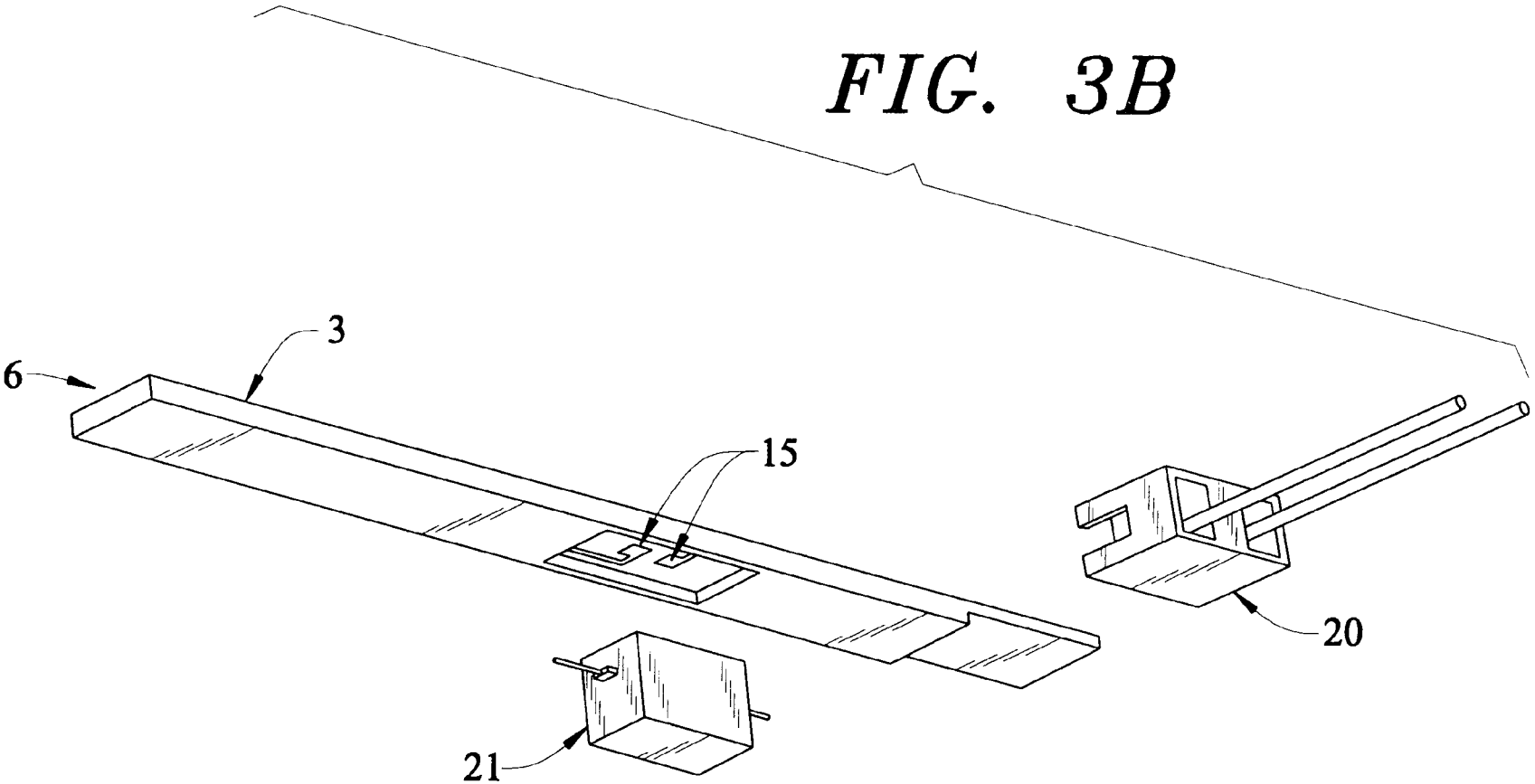
FIG. 3B is a perspective view showing the bottom face of a said second embodiment of the heater of the present invention.

FIG. 2A and 2B show two separate connectors for the AC and DC circuits. The connectors snap together around the heater substrate 3. These connectors will require that in use, the heater have additional physical support, particularly of the longitudinal end of the substrate 3 opposite that where the connectors are, to prevent breakage during use. One way of addressing this physical support need is to mount the DC connector 21 in a plastic housing to which the heater 6 would be mounted. This embodiment is illustrated in FIGS. 3A and 3B of the present application. Further, placing the DC connector 21 in the middle of the back face of the heater helps provide additional support along the entire length of the heater 6.

While the invention herein has been described with reference to the structures disclosed, it is not confined to the details set forth, and this application is intended to cover such modifications or changes as may come within the purposes of improvements or the scope of the following claims.

What is claimed is:

1. A heater for use in an electrophotographic printing process comprising:

a) a base member having two faces and two longitudinal ends;

b) one or more resistors extending along the length of the first face of said base member, said one or more resistors capable of generating heat upon supply of electrical power thereto;

c) first electric power supply contact for supplying electric power to said one or more resistors, said first contact located proximate to a longitudinal end of the base member on the first face of said base member;

d) a temperature detecting element for detecting the temperature of said base member, located on the second face of said base member; and e) second electric power supply contact for supplying electric power to said temperature-detecting element, said second contact located at the approximate middle on the second face of said base member.

2. A heater according to claim 1 wherein said base member has a high thermal conductivity.

3. A heater according to claim 2 wherein said base member comprises a ceramic material.

4. A heater according to claim 3 wherein said one or more resistors are supplied with AC power.

5. A heater according to claim 3 wherein said temperature detecting element is supplied with DC power.

6. A heater according to claim 4 wherein said temperature detecting element is supplied with DC power.

7. A heater according to claim 3 wherein said base member is flat and planar in shape.

8. A heater according to claim 1 wherein said heater is adapted for use in an image fixing apparatus for heat-fixing an image on a recording material, and wherein said fixing apparatus comprises electric power supply control means for controlling the electric power supply to said one or more resistors in accordance with the output of said temperature detecting element.

9. An image fixing apparatus comprising:

a) a heater according to claim 1;

b) a film in slidable contact with said heater;

c) a back-up member cooperative with said heater to form a nip with said heater with said film therebetween;

wherein a recording material is nipped and moved through said nip so that an image is fixed on the recording material.

10. A heater for use in an electrophotographic printing process comprising:

a) a base member having two faces and two longitudinal ends;

b) one or more resistors extending along the length of the first face of said base member, said one or more resistors capable of generating heat upon supply of electrical power thereto;

c) first electric power supply contact for supplying electric power to said one or more resistors, said first contact located proximate to a longitudinal end of the base member on the first face of said base member;

d) a temperature detecting element for detecting the temperature of said base member, located on the second face of said base member; and e) second electric power supply contact for supplying electric power to said temperature-detecting element, said contact located on the second face of said base member spaced longitudinally from said end of said base member in a housing mounted to said base member to physically support said base member.

11. A heater according to claim 10 wherein said base member has a high thermal conductivity.

12. A heater according to claim 11 wherein said base member comprises a ceramic material.

13. A heater according to claim 12 wherein said one or more resistors are supplied with AC power.

14. A heater according to claim 12 wherein said temperature detecting element is supplied with DC power.

15. A heater according to claim 13 wherein said temperature detecting element is supplied with DC power.

16. A heater according to claim 10 wherein the second power supply contact is located at approximate middle of the second face of said base member.

17. A heater according to claim 16 wherein said heater is adapted for use in an image fixing apparatus for heat-fixing an image on a recording material, and wherein said fixing apparatus comprises electric power supply control means for controlling the electric power supply to said one or more resistors in accordance with the output of said temperature detecting element.

18. An image fixing apparatus comprising:

a) a heater according to claim 16;

b) a film in slidable contact with said heater;

c) a back-up member cooperative with said heater to form a nip with said heater with said film therebetween;

wherein a recording material is nipped and moved through said nip so that an image is fixed on the recording material.

* * * * *

UNITED STATES PATENT AND TRADEMARK OFFICE

CERTIFICATE OF CORRECTION

PATENT NO. : 6,090,305
DATED : July 18, 2000
INVENTOR(S) : Stacey Edward Balch; Peter Alden Bayerle; Douglas Campbell Hamilton It is certified that error appears in the above-identified patent and that said Letters Patent is hereby corrected as shown below:

Column 8, claim 10,
Line 33, between "said" and "contact" insert -- second --.

Signed and Sealed this

Eighteenth Day of December, 2001

*Attest:*

*Attesting Officer*

JAMES E. ROGAN
*Director of the United States Patent and Trademark Office*